US008545263B2

(12) United States Patent
Islam

(10) Patent No.: US 8,545,263 B2
(45) **Date of Patent: *Oct. 1, 2013**

(54) CLAMP AND GRIP COAXIAL CONNECTOR

(75) Inventor: Nahid Islam, Westmont, IL (US)

(73) Assignee: Andrew LLC, Hickory, NC (US)

( * ) Notice: Subject to any disclaimer, the term of this patent is extended or adjusted under 35 U.S.C. 154(b) by 68 days.

This patent is subject to a terminal disclaimer.

(21) Appl. No.: 13/321,608

(22) PCT Filed: Jun. 4, 2010

(86) PCT No.: PCT/US2010/037491

§ 371 (c)(1),
(2), (4) Date: Nov. 21, 2011

(87) PCT Pub. No.: WO2010/141880

PCT Pub. Date: Dec. 9, 2010

(65) Prior Publication Data

US 2012/0064764 A1 Mar. 15, 2012

Related U.S. Application Data

(60) Provisional application No. 61/184,573, filed on Jun. 5, 2009.

(51) Int. Cl.
*H01R 9/05* (2006.01)

(52) U.S. Cl.
USPC ..... 439/578; 174/89

(58) Field of Classification Search
USPC ..... 439/583–585, 578, 579, 586; 174/89
See application file for complete search history.

(56) References Cited

U.S. PATENT DOCUMENTS

| | | | | |
|---|---|---|---|---|
| 3,963,320 | A | 6/1976 | Spinner | |
| 4,046,451 | A | 9/1977 | Juds et al. | |
| 4,676,577 | A | 6/1987 | Szegda | |
| 4,824,400 | A | 4/1989 | Spinner | |
| 6,217,384 | B1 * | 4/2001 | Strasser et al. | 439/583 |
| 6,234,838 | B1 | 5/2001 | Wong | |
| 6,793,529 | B1 * | 9/2004 | Buenz | 439/583 |
| 6,994,587 | B2 | 2/2006 | Buenz et al. | |
| 7,607,942 | B1 | 10/2009 | Van Swearingen | |
| 7,635,283 | B1 * | 12/2009 | Islam | 439/583 |
| 7,857,661 | B1 * | 12/2010 | Islam | 439/584 |
| 2005/0079761 | A1 | 4/2005 | Rodrigues | |
| 2006/0014427 | A1 | 1/2006 | Islam et al. | |
| 2007/0224880 | A1 | 9/2007 | Wlos et al. | |
| 2009/0053931 | A1 | 2/2009 | Islam | |

* cited by examiner

*Primary Examiner* — Tho D Ta
*Assistant Examiner* — Harshad Patel
(74) *Attorney, Agent, or Firm* — Babcock IP, PLLC

(57) ABSTRACT

A coaxial connector with a connector body is provided with a connector body bore. An annular coupling groove is provided in the connector body bore open to a cable end of the connector body. A clamp sidewall of the coupling grove is angled inward from a bottom of the coupling groove. A slip ring seated within the coupling body bore is provided with a grip surface. An annular compression body is positioned between the slip ring and the clamp sidewall. The connector body and the coupling body are coupled together via threads. The slip ring is dimensioned for axial advance of the coupling body along the threads to exert a compression force against the compression body to clamp a leading edge of the outer conductor between the compression body and the clamp sidewall.

18 Claims, 13 Drawing Sheets

CLAMP AND GRIP COAXIAL CONNECTOR

CROSS REFERENCE TO RELATED APPLICATIONS

This application claims the benefit of U.S. Provisional Patent Application Ser. No. 61/184,573 "Coaxial Connector for Solid Outer Conductor Coaxial Cable" filed Jun. 5, 2009 by Nahid Islam and Al Cox, currently pending and hereby incorporated by reference in its entirety.

BACKGROUND OF THE INVENTION

1. Field of the Invention

The invention relates to electrical connectors for coaxial cable. More particularly the invention relates to a coaxial connector with outer conductor gripping features for assisting interconnection and/or increasing the strength of the connector to coaxial cable interconnection.

2. Description of Related Art

A positive stop type coaxial connector, for example as disclosed in commonly owned U.S. Pat. No. 6,793,529 titled: "Coaxial Connector with Positive Stop Clamping Nut Attachment", by Larry Buenz, issued Sep. 21, 2010, hereby incorporated by reference in its entirety, has a connector body and a back nut configured for threaded interconnection. As the connector body and back nut are threaded together, a flared leading edge of the outer conductor of the coaxial cable is clamped between the connector body and the coupling body in a secure electro-mechanical interconnection. To indicate proper threading completion and avoid damage to the connector and/or coaxial cable from overtightening, a positive stop between the connector body and the back body may be applied wherein the threading between the back body and connector body bottoms at a specific axial location at which the desired maximum tightening compression/torque force occurs, definitively signaling the installer that the proper amount of tightening has been reached. To allow for thermal expansion cycling and/or variances in manufacture of the connector and/or the outer conductor dimensions, a compression element is inserted between internal contacting surfaces of the outer conductor, back body and/or the connector body.

Prior positive stop type coaxial connector designs typically require flaring of the outer conductor to enable a sandwich clamp action between the connector body, the leading edge of the outer conductor and the back nut. Although a corrugated outer conductor coaxial cable provides a suitable outer diameter grip surface for a user during the flaring procedure, the smooth outer diameter of a smooth wall outer conductor coaxial cable may be difficult to easily grip during flaring.

A current market trend is to replace traditional copper material coaxial cables with aluminum material coaxial cables to save materials cost and lower the weight per unit length of the coaxial cable. Further, smooth wall outer conductor cables provide inherent materials cost and cable weight advantages compared to corrugated outer conductor coaxial cable configurations.

Aluminum has lower mechanical strength properties including cold work properties (bending) compared to copper. Aluminum is susceptible to creep and may weaken at a single contact point with extreme contact pressure due to bending, pulling and/or twisting.

Smooth wall cable is less flexible compared to corrugated cable; however users used to working with corrugated coaxial cable may not recognize the lower bend capability of smooth wall cable. Users attempting to apply improper bend radii may overstress a conventional coaxial connector and cable interconnection.

Competition within the coaxial cable and connector industry has focused attention upon improving electrical performance as well as reducing manufacturing, materials and installation costs.

Therefore, it is an object of the invention to provide a method and apparatus that overcomes deficiencies in such prior art.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

For clarity, similar elements between different embodiments utilize the same notations and some notations appearing on the different figures may not be specifically identified on each figure.

DETAILED DESCRIPTION

One skilled in the art will appreciate that the connector end 1 and the cable end 3 are descriptors used herein to clarify longitudinal locations and/or contacting interrelationships between the various elements of the coaxial connector(s). In addition to the identified positions in relation to adjacent elements along the longitudinal axis of the coaxial connector 5, each individual element has a connector end side and a cable end side, i.e. the sides of the respective element that are facing the respective connector end 1 and the cable end 3 of the coaxial connector 5.

Figure 1:
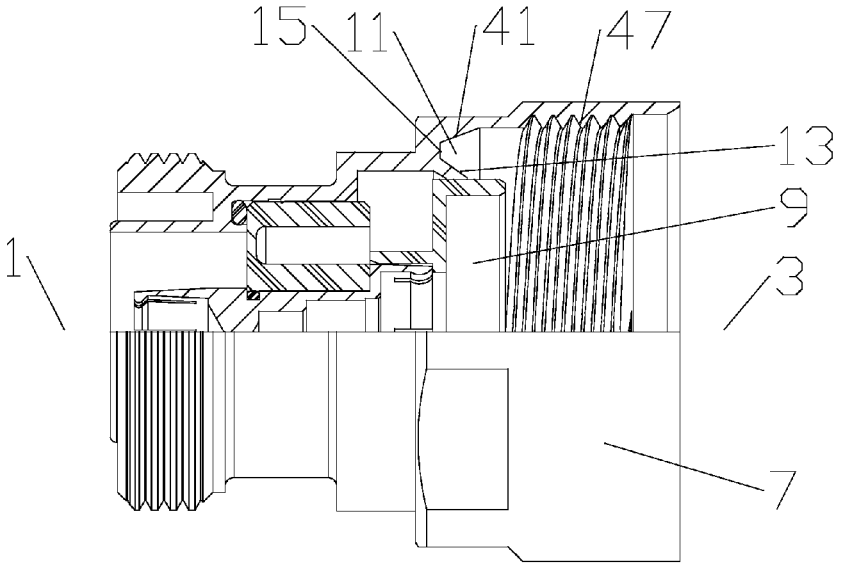
FIG. 1 is a schematic 90 degree cut-away side view of a first embodiment of a connector body.
Figure 2:
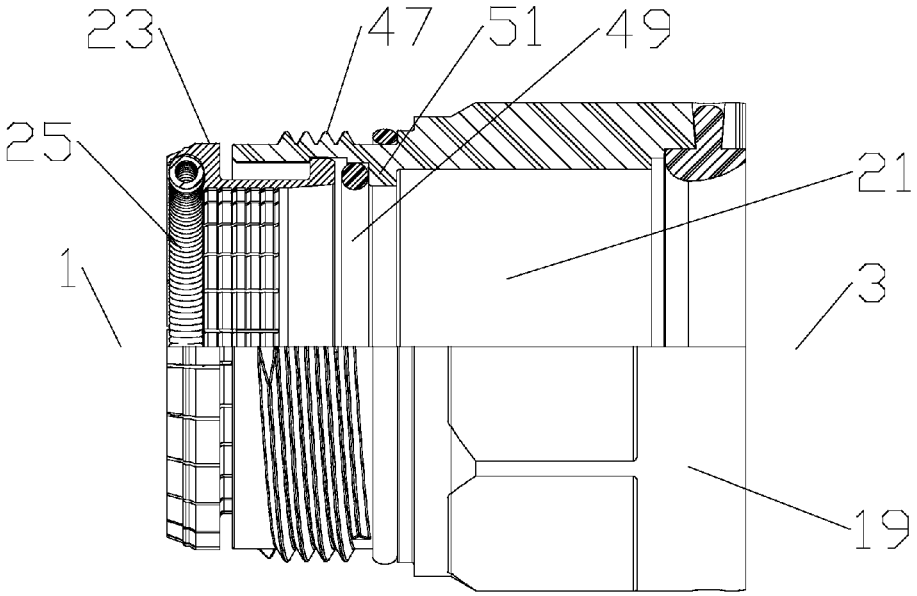
FIG. 2 is a schematic 90 degree cut-away side view of a first embodiment coupling body with slip ring and compression body attached.

A first embodiment of a coaxial connector, as shown in FIGS. 1-8, includes a connector body 7 provided with a connector body bore 9. As best shown in FIG. 1, an annular coupling groove 11 provided in the connector body bore 3 is open to a cable end 3 of the connector body 7. A clamp sidewall 13 of the coupling grove 11 is angled inward from a bottom 15 of the coupling groove 11, dimensioned as a seat against which a leading edge of the outer conductor 17 is clamped. As best shown in FIG. 2, a coupling body 19 provided with a coupling body bore 21 dimensioned to fit over the outer conductor 17 of the coaxial cable is threadable into the cable end 3 of the connector body 7.

Figure 3:
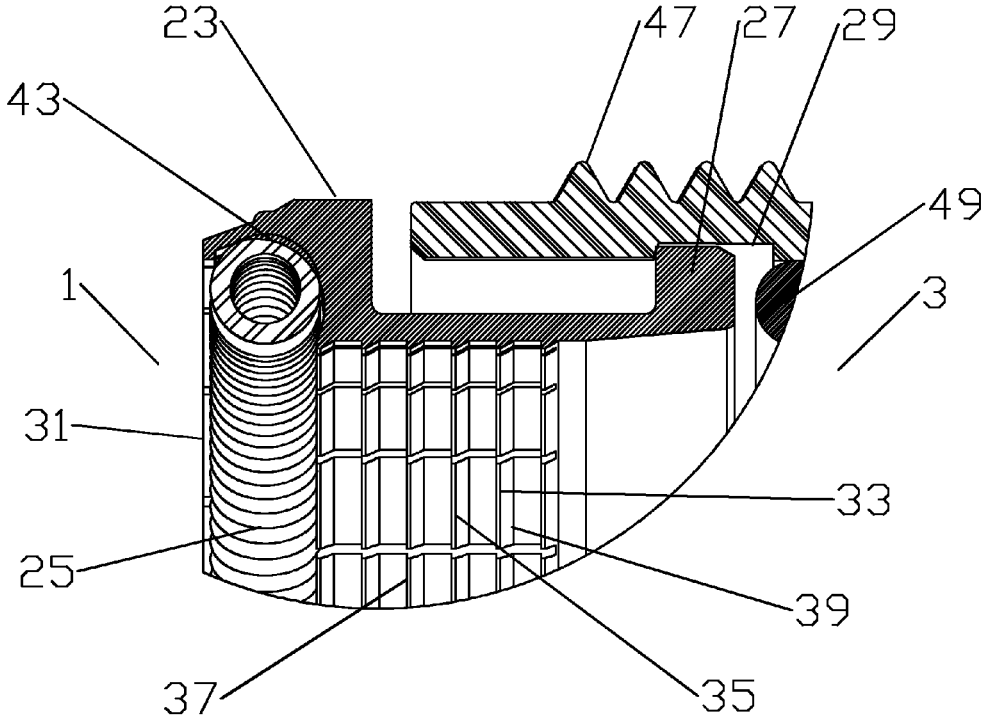
FIG. 3 is a close-up view of FIG. 2.
Figure 4:
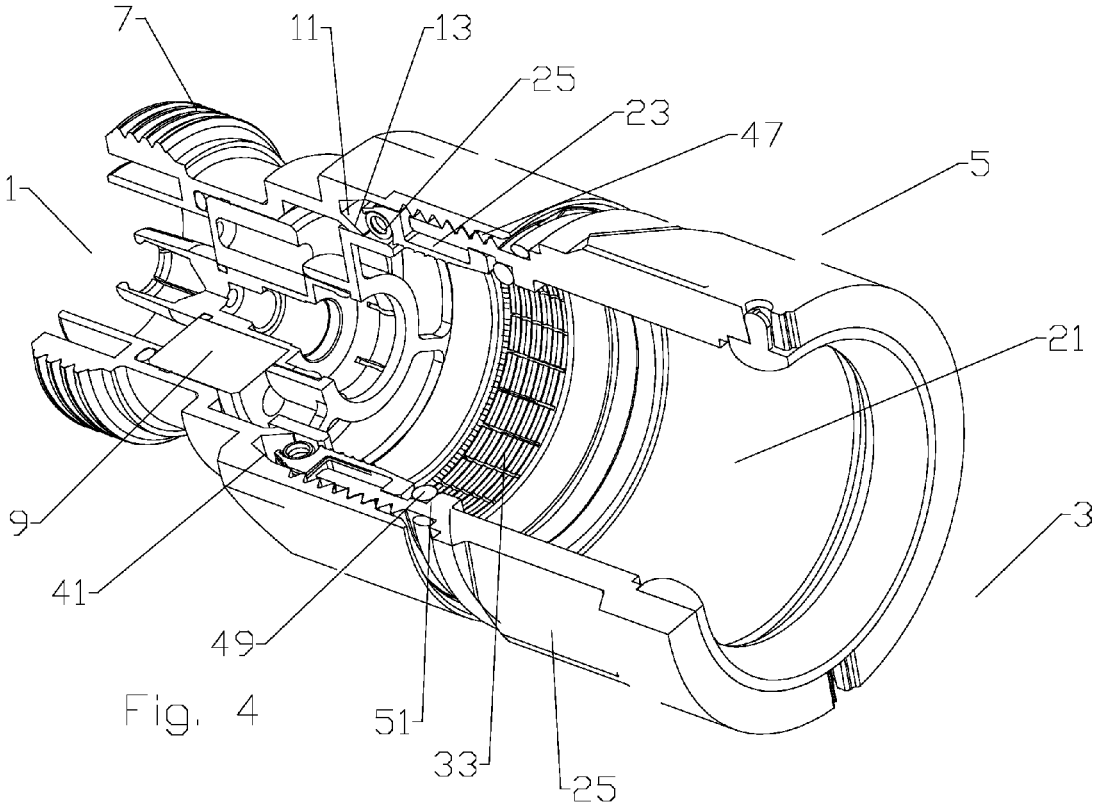
FIG. 4 is a schematic isometric 90 degree cut-away view of the coupling body and connector body of FIGS. 1 and 2, with the coaxial cable removed for clarity.

A slip ring 23 positioned at a connector end 1 of the coupling body 19 is dimensioned to drive an annular compression body 25, for example a helical coil spring, against the clamp sidewall 13 to clamp the leading edge of the outer conductor 17 therebetween in a secure electro-mechanical interconnection. As best shown in FIG. 3, the slip ring 23 may be retained coupled to the coupling body 19 by an outward projecting coupling shoulder 27 at the cable end 3 of slip ring 23 seated within an annular retention groove 29 of the coupling body bore 21.

Figure 5:
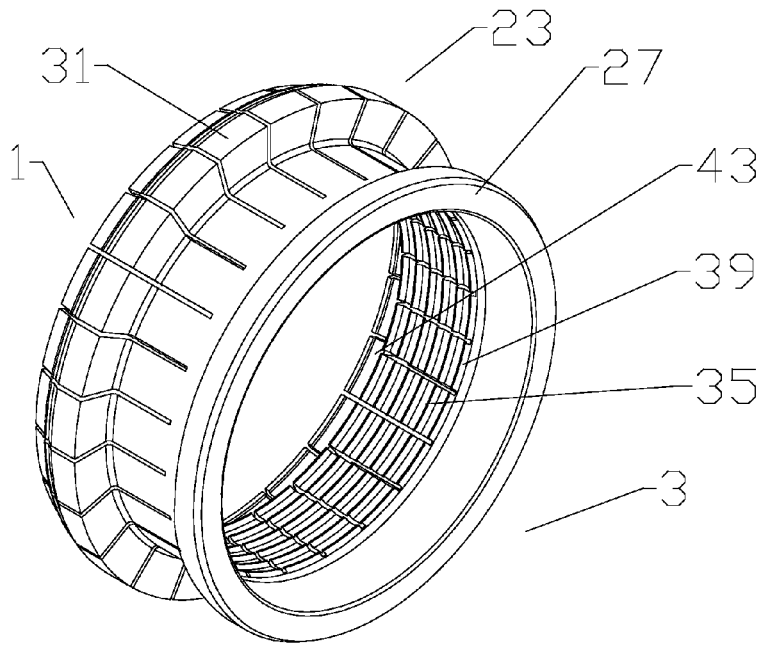
FIG. 5 is a schematic isometric angled cable end view of a first embodiment of a slip ring.
Figure 6:
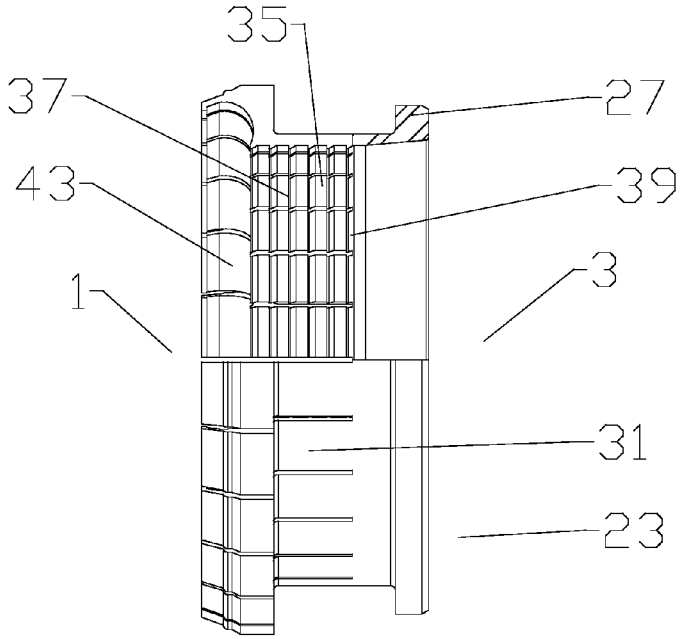
FIG. 6 is a schematic 90 degree cut-away side view of FIG. 5.

As best shown in FIGS. 5 and 6, the slip ring 23 has a plurality of coupling spring finger(s) 31 extending towards the connector end 1, the inner diameter of the coupling spring finger(s) 31 provided with a grip surface 33. The grip surface 33 may be formed as a plurality of annular barb(s) 35, for example each of the barb(s) 35 provided with a stop surface 37 at a connector end side and an insertion surface 39 at a cable end side, the stop surface 37 provided normal to a longitudinal axis and the insertion surface 39 angled towards the connector end 1. Thereby, the outer conductor 17 may be inserted past the barb(s) 35 spreading the coupling spring finger(s) 31 outward and sliding over the angled insertion surface(s) 39 toward the connector end 1, but the stop surface(s) 37 will bite into and grip the outer diameter surface of the outer conductor 17 if movement toward the cable end 3 is attempted. Alternatively, the grip surface 33 may be formed, for example, as a helical thread or knurled surface of annular teeth cut in a short section or as a diamond knurl created by two threads, one right hand and one left hand.

Figure 7:
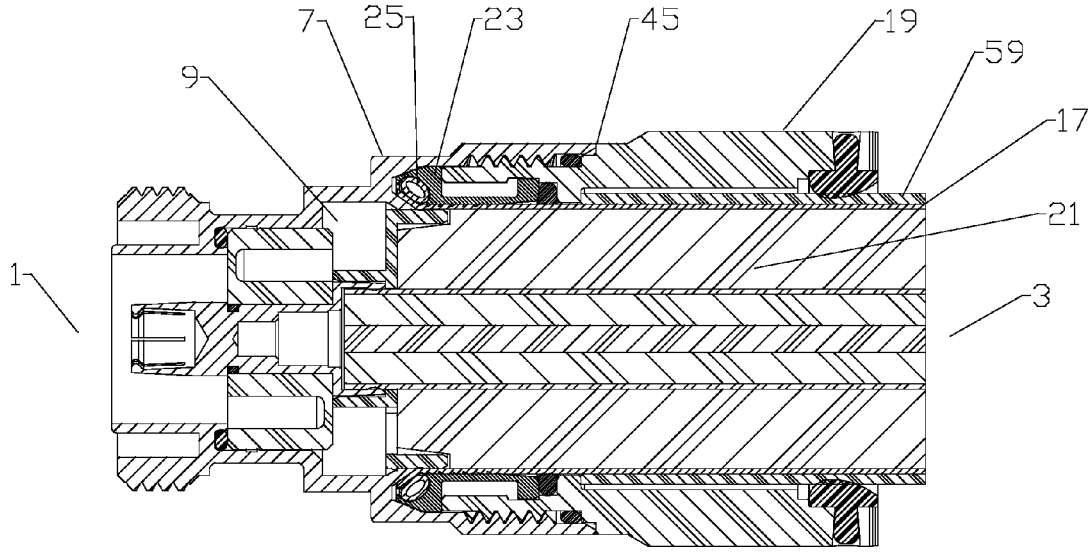
FIG. 7 is a schematic cut-away side view of the first embodiment coaxial connector (FIGS. 1, 2 and 3 assembled) with a coaxial cable attached.
Figure 8:
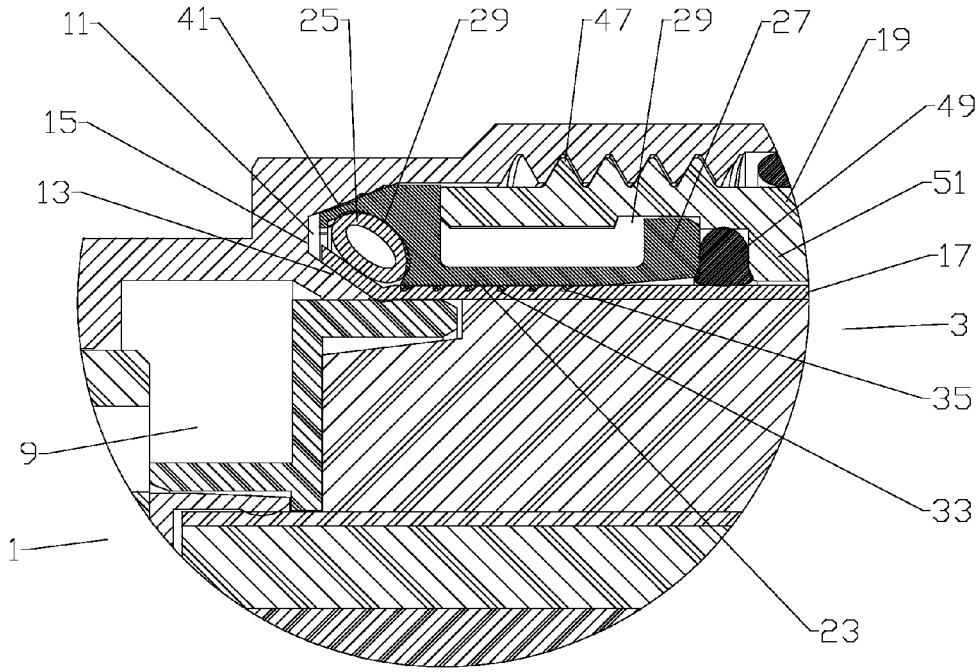
FIG. 8 is a close-up view of FIG. 7.
Figure 9:
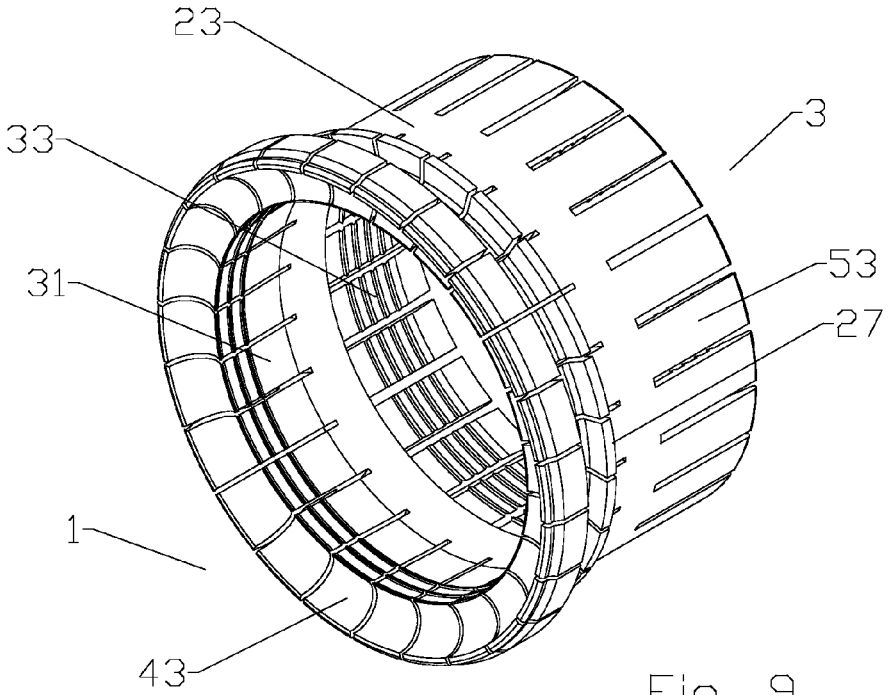
FIG. 9 is a schematic isometric connector end view of a second embodiment of a slip ring.
Figure 10:
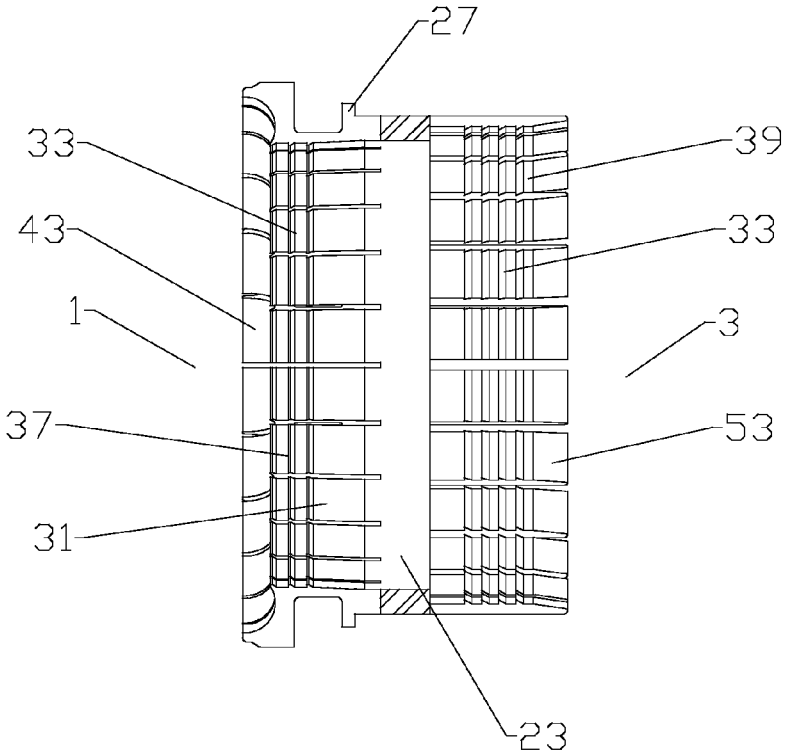
FIG. 10 is a cut-away side view of FIG. 9.
Figure 11:
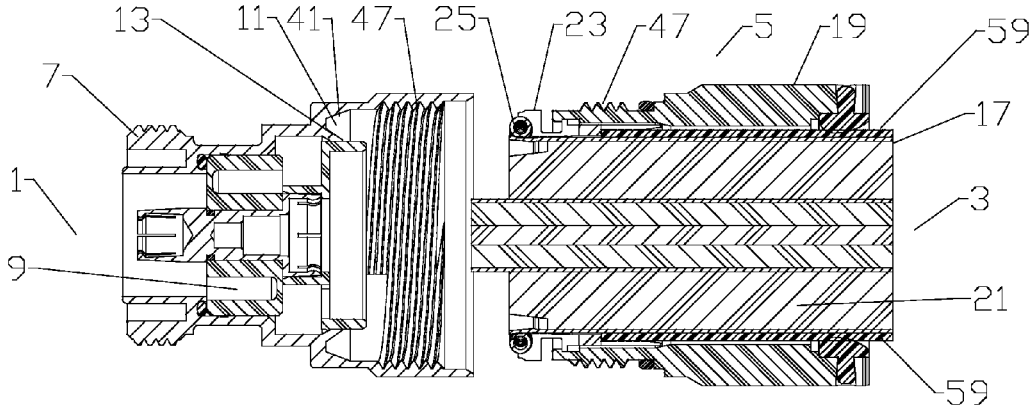
FIG. 11 is a cut-away side view of a second embodiment with coaxial cable mounted on the coupling body, prior to coupling with the connector body.
Figure 12:
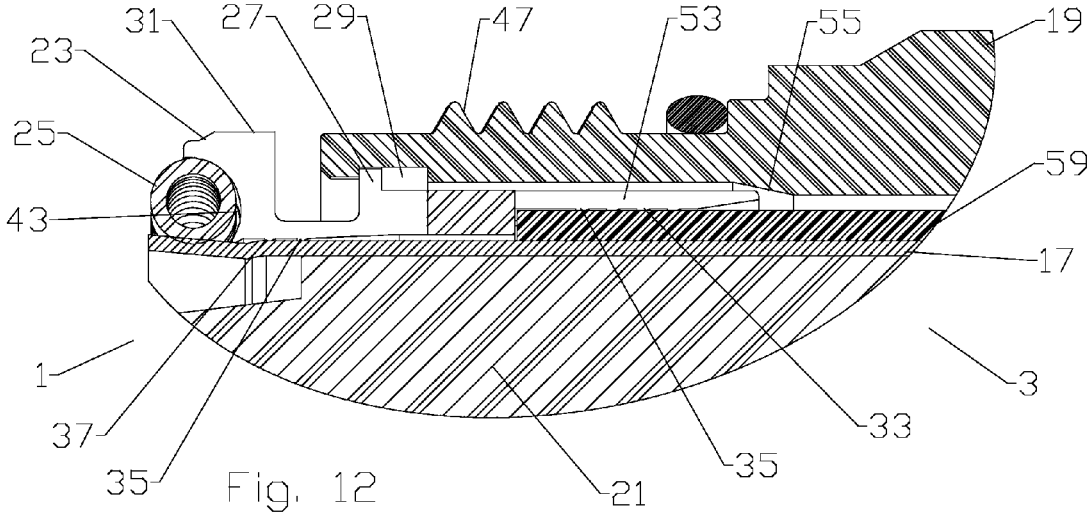
FIG. 12 is a close-up view of FIG. 11.
Figure 13:
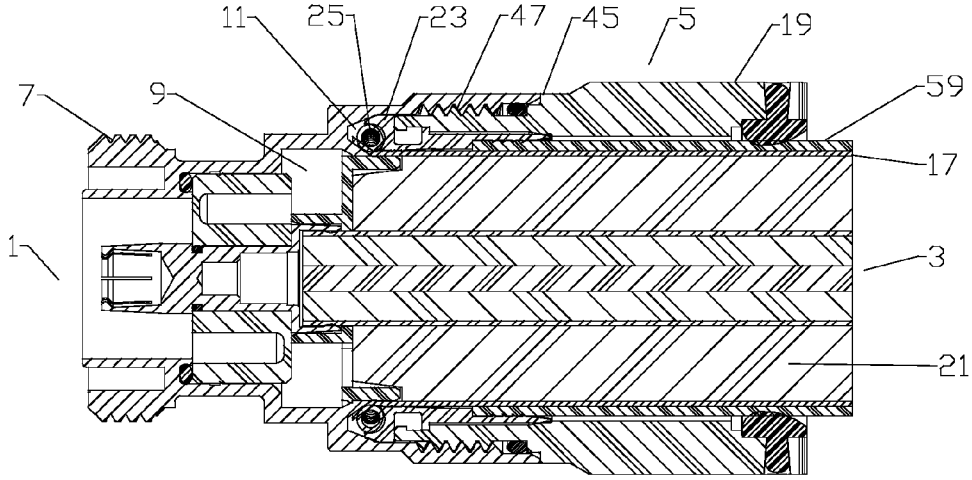
FIG. 13 is a cut-away side view of the second embodiment coaxial connector with the coaxial cable attached.
Figure 14:
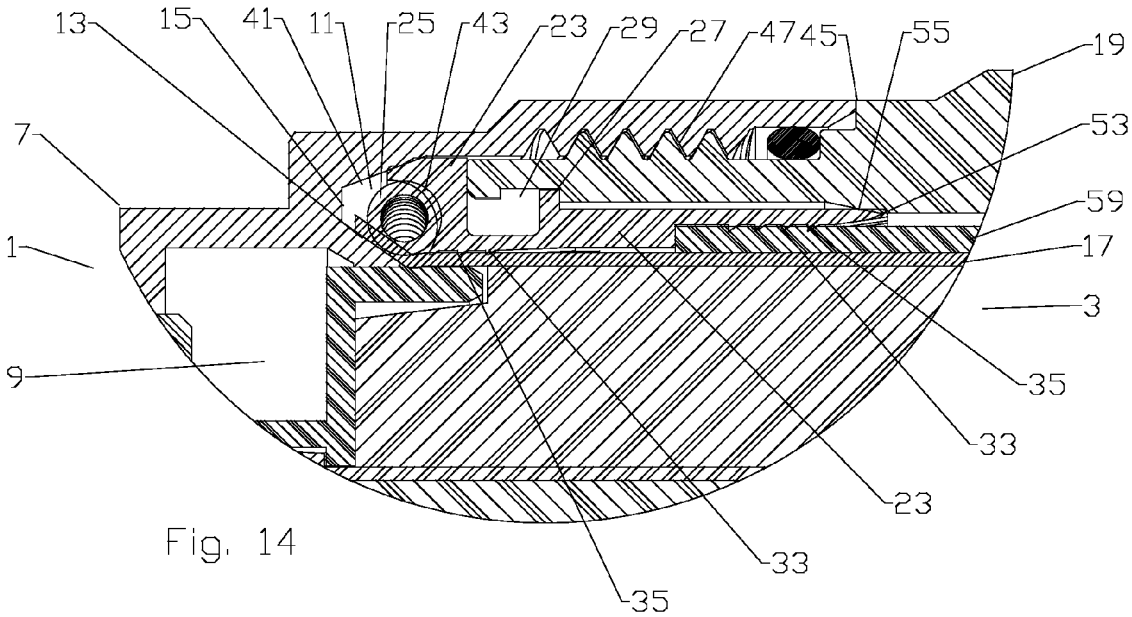
FIG. 14 is a close-up view of FIG. 13.

As the coupling body 19 is inserted in and threaded into the connector body 7, an outer diameter of the distal end of the coupling spring finger(s) 31 engages a compression sidewall 41 angled outward from the bottom of the coupling groove 11, the decreasing diameter of the compression sidewall 41 driving the coupling spring finger(s) 31 radially inward toward the clamp sidewall 13 and outer conductor 17. Thereby, as best shown in FIGS. 7 and 8, circumferential reinforcement is provided for the slip ring 23 by the connector body 7, reducing the structural requirements of the slip ring 23 and enabling a corresponding reduction in an outer diameter of the coaxial connector 5. Further, as the coupling spring finger(s) 31 are driven radially inward by the contact with the compression sidewall 41, the grip surface 33 is driven into secure contact with the outer conductor 17.

The compression body 25 may be seated within an annular compression body groove 43 provided on an inner diameter of the distal end of the coupling spring finger(s) 31. The compression body groove 43 may be formed with the coupling spring finger(s) 31 extending towards the cable end 3 farther than the compression body 25, providing a cradle for the compression body 25 which guides deformation of the compression element against the leading edge of the outer conductor 17 to clamp against the clamp sidewall 13 as the coupling body 19 is axially advanced into the connector body 7 by threading.

A compression force generated by the axial advance of the coupling body 19 to clamp the leading edge of the outer conductor 17 between the compression body 25 and the clamp sidewall 13 and also a radial displacement of the grip surface 33 against the outer diameter of the outer conductor 17 may be limited by the application of a surface to surface positive stop 45 (FIG. 7) between the coupling body 19 and the connector body 7 that stops the compression force at a predetermined maximum torque by preventing further movement (threading) of the coupling body 19 toward the connector body 7.

The threading between the connector body 7 and the coupling body 19 (FIGS. 1 and 2) may be applied as multiple interleaved thread(s) 47, for example four threads, increasing the thread pitch to significantly reduce the number of rotations required to advance the coupling body 19 to the positive stop 45 engagement with the connector body 7, without unacceptably reducing the strength characteristics of the resulting threaded interconnection.

An axial play between the coupling shoulder 27 and the retention groove 29 of the coupling body 19 may be utilized to compress a gasket 49 seated between a cable end 3 of the slip ring 23 and an inward projecting gasket shoulder 51 of the coupling body bore 21. Thereby, the outer conductor 17 may be easily inserted through the gasket 49 while in an uncompressed state and then, as the coupling body 19 is advanced towards the connector body 7, the slip ring 23 is driven towards the cable end 3 of the retention groove 29, which compresses the gasket 49 against the gasket shoulder 51, deforming it radially inward into secure sealing engagement with the outer diameter of the outer conductor 17.

One skilled in the art will appreciate that the combination of leading edge outer conductor clamping with outer conductor gripping via the grip surface 33 may provide improved interconnection strength and/or additional strain relief by distributing stress from the front edge of the outer conductor 17 across the outer diameter of the outer conductor 17. Further a cable pull strength and anti rotation strength of the interconnection may be improved, stabilizing the interconnecting surfaces with one another to improve the IMD characteristic of the interconnection.

In further embodiments, for example as shown in FIGS. 9-14, these attributes may be further enhanced by providing the slip ring 23 with a plurality of grip spring finger(s) 53 extending from a cable end 3 of the slip ring 23. A corresponding inward projecting wedge shoulder 55 of the coupling body bore 9 contacts the grip spring finger(s) 53 to drive another inner diameter grip surface 33 of the grip spring finger(s) 53 radially inward into secure engagement with the jacket 59 of the coaxial cable as the coupling body 19 advances along the thread(s) 47 during interconnection.

Figure 15:
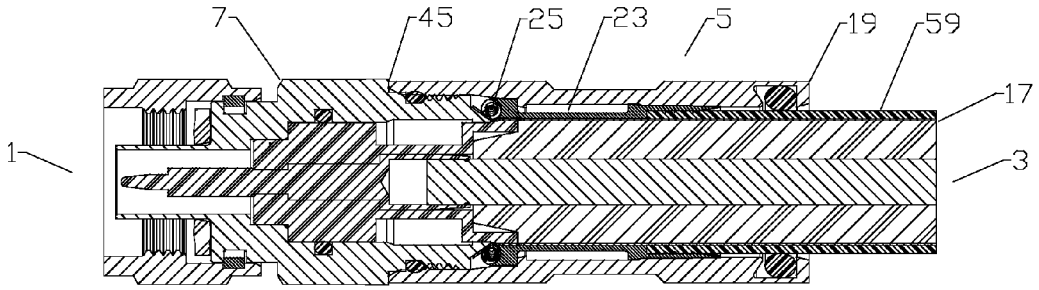
FIG. 15 is a schematic cut-away side view of a third embodiment of a coaxial connector with the coaxial cable attached.
Figure 16:
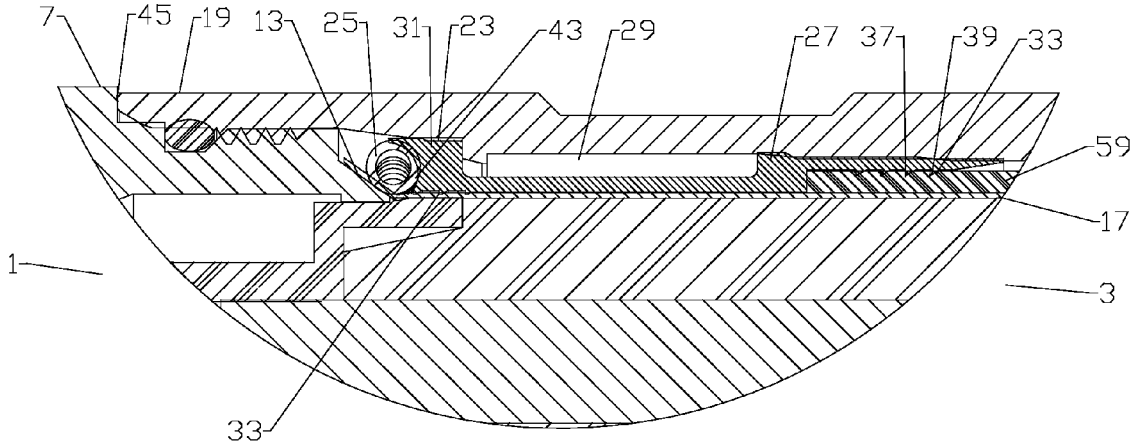
FIG. 16 is a close-up view of FIG. 15.
Figure 17:
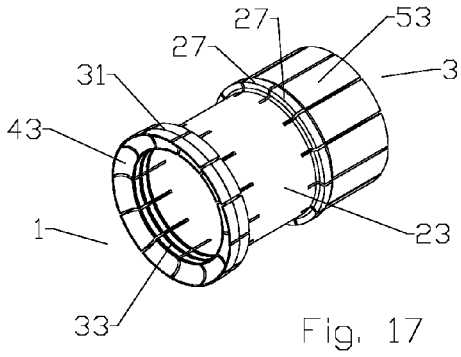
FIG. 17 is a schematic isometric view of a third embodiment of a slip ring.
Figure 18:
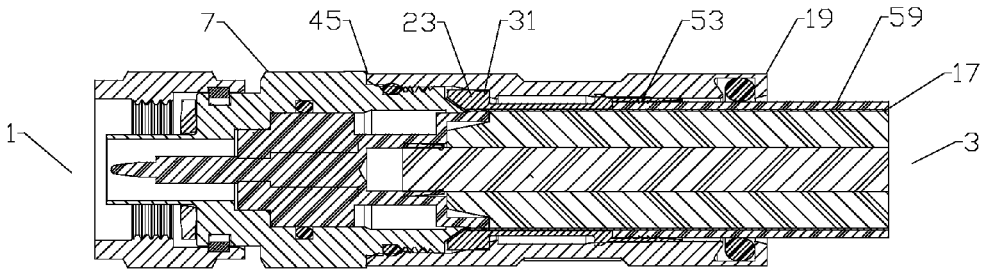
FIG. 18 is a schematic cut-away side view of a fourth embodiment of a coaxial connector with the coaxial cable attached.
Figure 19:
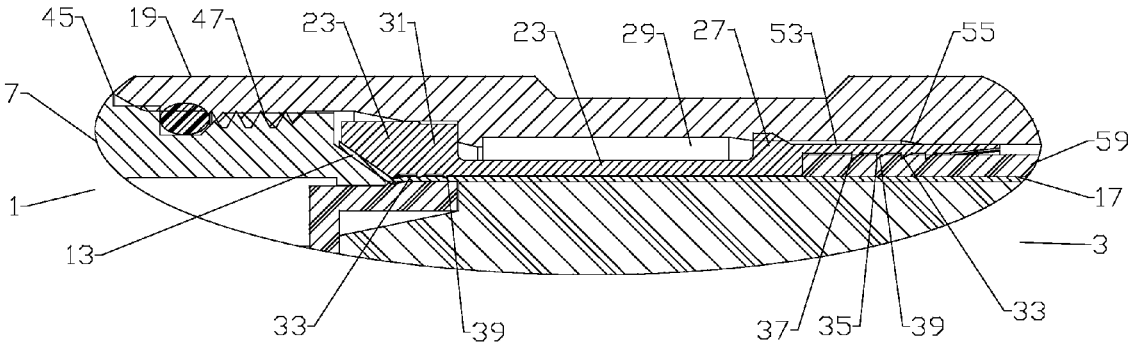
FIG. 19 is a close-up view of FIG. 18.
Figure 20:
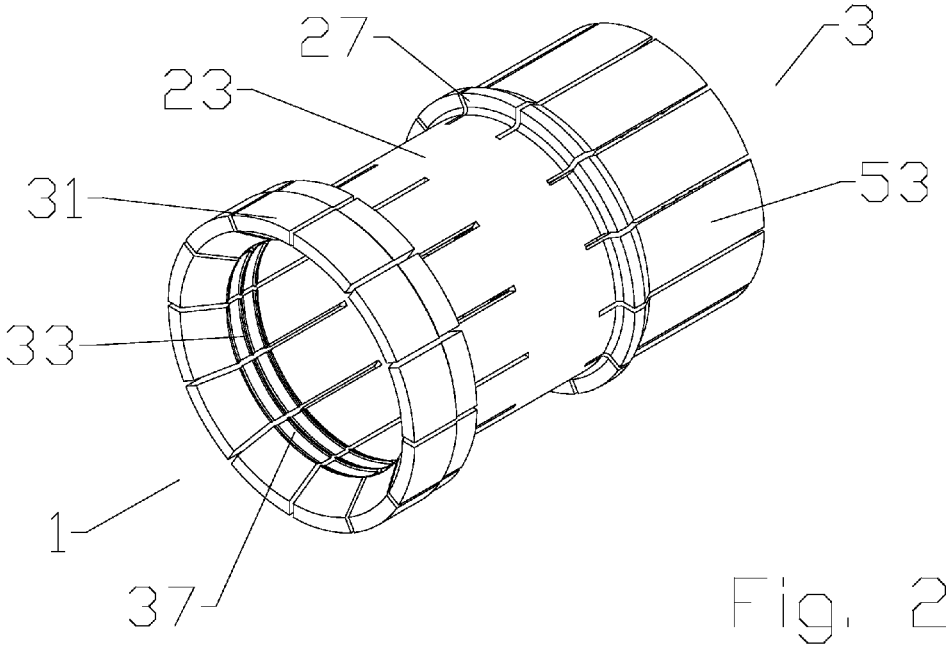
FIG. 20 is a schematic isometric view of a fourth embodiment of a slip ring.
Figure 21:
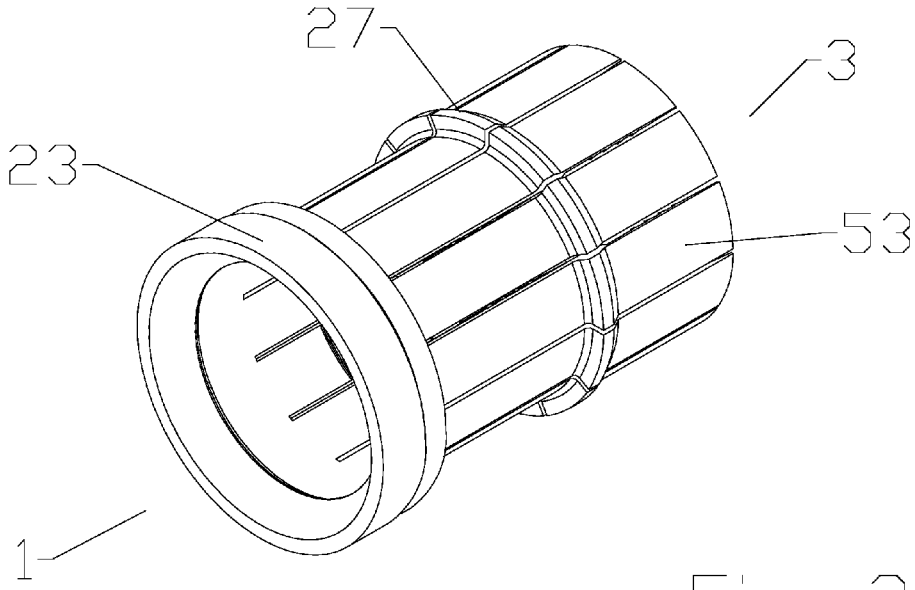
FIG. 21 is a schematic isometric view of an alternative slip ring.

One skilled in the art will appreciate that the benefits of the slip ring 23 with grip surface 33 may also be realized in coaxial connector configurations wherein the connector body 7 threads into the coupling body 19, for example as shown in FIGS. 15-17. Also, the slip ring 23 with grip surface 33 may be applied in a conventional clamp configuration with cable end grip spring finger(s) 53 stabilizing the interconnection with jacket 59, but without a compression body 25, for example as shown in FIGS. 18 and 19. Even though a compression element and compression sidewall 41 is omitted, as shown for example in FIG. 20, coupling spring finger(s) 31 may still be applied facilitate easy insertion of the outer conductor 17 past the grip surface 33. Further, where the grip surface 33 is not applied proximate the connector end 1, coupling spring finger(s) 31 may be omitted from the respective connector end 1, as shown for example in FIG. 21.

Figure 22:
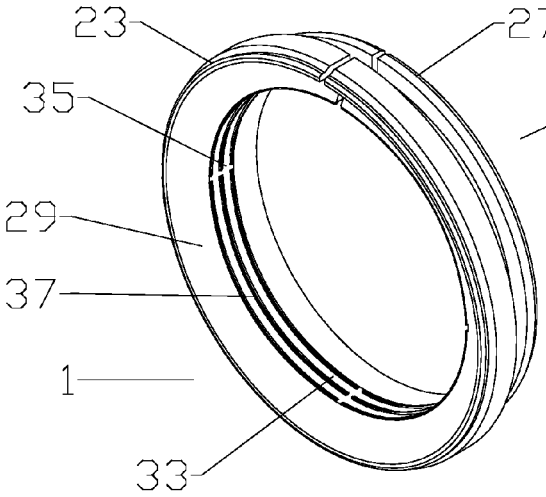
FIG. 22 is a schematic isometric connector end view of an alternative c-shaped slip ring.
Figure 23:
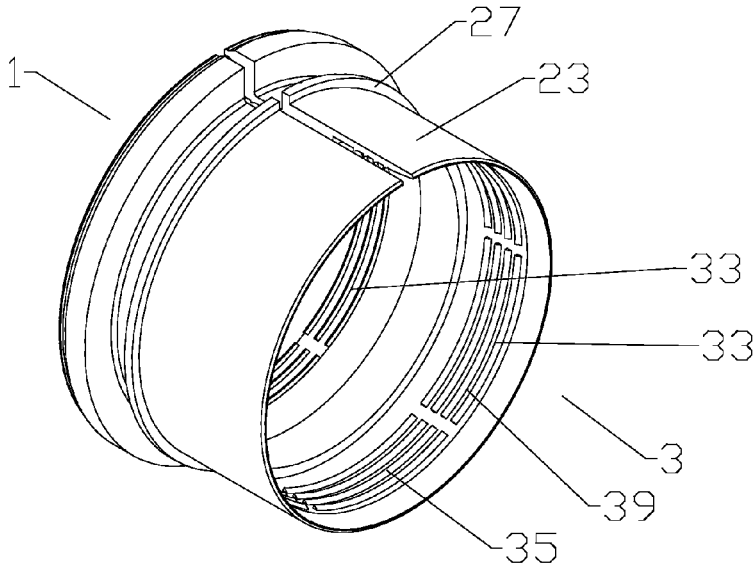
FIG. 23 is a schematic isometric connector end view of an alternative c-shaped slip ring.
Figure 24:
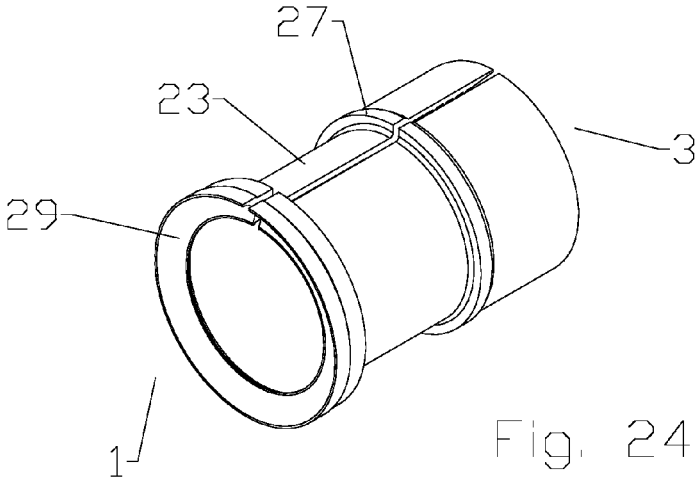
FIG. 24 is a schematic isometric connector end view of an alternative c-shaped slip ring.

To simplify manufacture, the slip ring 23 may be provided in a c-shaped configurations, for example as shown in FIGS. 22-24, without coupling spring finger(s) 31 or grip spring finger(s) 53 as applicable, the gap of the c-shape enabling a limited radial inward movement as either end of the slip ring 23 encounters a respective decreasing radius surface and the slot of the c-shape providing an anti-rotation edge engaged with the outer conductor 17.

Figure 25:
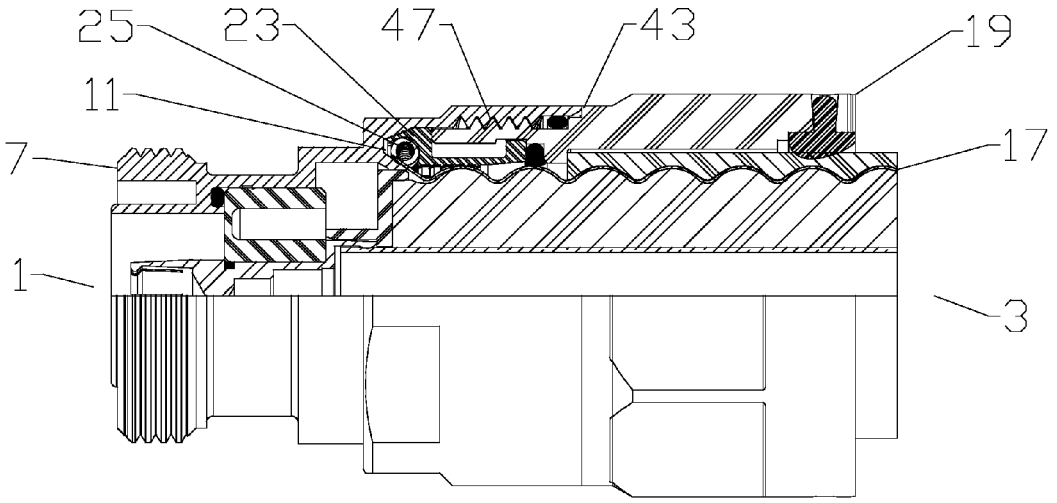
FIG. 25 is a schematic isometric 90 degree cut-away side view of the first embodiment coaxial connector, with an annular corrugated outer conductor coaxial cable attached.
Figure 26:
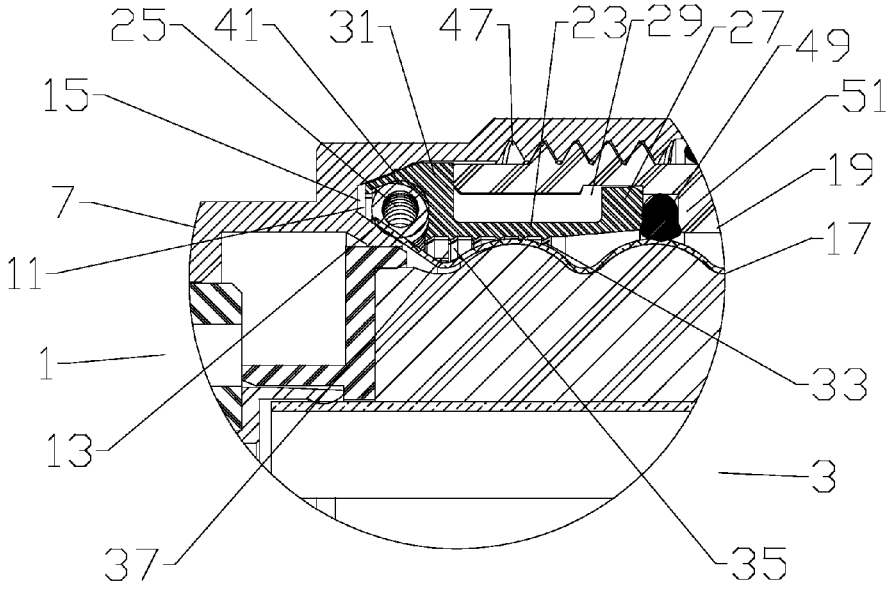
FIG. 26 is a close-up view of FIG. 25.

Although the disclosed embodiments are particularly suited for smooth wall solid outer conductor cable, these may also be applied to other solid outer conductor configurations, such as annular corrugated solid outer conductor, as shown for example in FIGS. 25 and 26. Therein the coaxial cable is prepared by cutting the end at a corrugation peak, which positions the coaxial cable to present a corrugation peak for the sealing gasket to be compressed against and enables the leading edge of the outer conductor to seat against the slip ring lip.

One skilled in the art will appreciate that providing the slip ring pre-attached to the coupling body, significantly decreases the chances for loosing separate elements of the connector prior to assembly and/or improper assembly.

Table of Parts

| | |
|---|---|
| 1 | connector end |
| 3 | cable end |
| 5 | coaxial connector |
| 7 | connector body |
| 9 | connector body bore |
| 11 | coupling groove |
| 13 | clamp sidewall |
| 15 | bottom |
| 17 | outer conductor |
| 19 | coupling body |
| 21 | coupling body bore |
| 23 | slip ring |
| 25 | compression body |
| 27 | coupling shoulder |
| 29 | retention groove |
| 31 | coupling spring finger |
| 33 | grip surface |
| 35 | barb |
| 37 | stop surface |
| 39 | insertion surface |
| 41 | compression sidewall |
| 43 | compression body groove |
| 45 | positive stop |

-continued

Table of Parts

| | |
|---|---|
| 47 | thread |
| 49 | gasket |
| 51 | gasket shoulder |
| 53 | grip spring finger |
| 55 | wedge shoulder |
| 59 | jacket |

Where in the foregoing description reference has been made to ratios, integers or components having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

I claim:

1. A coaxial connector for use with a coaxial cable with an outer conductor, comprising:

a connector body provided with a connector body bore;

an annular coupling groove provided in the connector body bore open to a cable end of the connector body;

a compression sidewall angled outward from the bottom of the coupling groove;

a clamp sidewall of the coupling groove angled inward from a bottom of the coupling groove;

a slip ring seated within the connector body bore, provided with a plurality of coupling spring fingers extending towards a connector end of the slip ring, an inner diameter of the coupling spring fingers provided with a grip surface; and an annular compression body between the coupling spring fingers and the clamp sidewall;

the connector body and the coupling body coupled together via threads;

the slip ring dimensioned for axial advancement of the coupling body along the threads to exert a compression force against the compression body to clamp a leading edge of the outer conductor between the compression body and the clamp sidewall;

the coupling spring fingers driven radially inward toward the clamp sidewall by contact with the compression sidewall.

2. The coaxial connector of claim 1, further including a surface to surface positive stop between the coupling body and the connector body that stops the compression force at a predetermined maximum torque by preventing further movement of the coupling body toward the connector body.

3. The coaxial connector of claim 1, wherein the slip ring is retained within the connector body bore by an outward projecting coupling shoulder at the cable end of the slip ring, the coupling shoulder seated within an annular retention groove of the coupling body bore.

4. The coaxial connector of claim 1, wherein the grip surface is a plurality of annular barbs.

5. The coaxial connector of claim 4, wherein each of the annular barbs has a stop surface at a connector end and an insertion surface at a cable end; the stop surface provided normal to a longitudinal axis and a diameter of the insertion surface increasing towards the connector end.

6. The coaxial connector of claim 1, wherein the compression body seats within a compression body groove of the coupling spring fingers.

7. The coaxial connector of claim 6, wherein the coupling spring fingers extend toward the cable end farther than the compression body.

8. The coaxial connector of claim 1, wherein the threads are multiple interleaved threads.

9. The coaxial connector of claim 1, further including a sealing gasket seated between a cable end of the slip ring and an inward projecting sealing gasket shoulder of the coupling body bore.

10. A coaxial connector for use with a coaxial cable with an outer conductor, comprising:

a connector body provided with a connector body bore;

an annular coupling groove provided in the connector body bore open to a cable end of the connector body;

a clamp sidewall of the coupling groove angled inward from a bottom of the coupling groove;

a slip ring seated within the connector body bore, provided with a plurality of coupling spring fingers extending towards a connector end of the slip ring, an inner diameter of the coupling spring fingers provided with a grip surface; and an annular compression body between the coupling spring fingers and the clamp sidewall;

a plurality of jacket grip spring fingers extending from a cable end of the slip ring;

the connector body and the coupling body coupled together via threads;

the slip ring dimensioned for axial advancement of the coupling body along the threads to exert a compression force against the compression body to clamp a leading edge of the outer conductor between the compression body and the clamp sidewall.

11. The coaxial connector of claim 10, further including a jacket wedge shoulder of the coupling body bore; the jacket wedge shoulder biasing the jacket grip spring fingers radially inward as the coupling body advances along the threads.

12. A coaxial connector for use with a coaxial cable with an outer conductor, comprising:

a connector body provided with a connector body bore;

the connector body provided with an inward angled annular clamp sidewall;

a coupling body with a coupling body bore; a slip ring seated within the coupling body bore; the slip ring provided with a plurality of axially projecting coupling spring fingers, an inner diameter of the coupling spring fingers provided with a grip surface;

a plurality of jacket grip spring fingers extending from a cable end of the slip ring;

the connector body and the coupling body coupled together via threads;

the slip ring dimensioned for axial advancement of the coupling body along the threads to generate a compression force clamping a leading edge of the outer conductor against the clamp sidewall.

13. The coaxial connector of claim 12, further including a surface to surface positive stop between the coupling body and the connector body that stops the compression force at a predetermined maximum torque by preventing further movement of the coupling body toward the connector body.

14. The coaxial connector of claim 12, wherein the slip ring is retained within the connector body bore by an outward projecting shoulder at the cable end seated within an annular retaining groove of the coupling body.

15. The coaxial connector of claim 12, further including a compression sidewall angled outward from the clamp sidewall;

the coupling spring fingers driven radially inward toward the clamp sidewall by contact with the compression sidewall as the coupling body is advanced towards the connector body.

16. The coaxial connector of claim 12, further including a jacket wedge shoulder of the coupling body bore; the jacket wedge shoulder biasing the jacket grip spring fingers radially inward as the coupling body advances along the threads.

17. The coaxial connector of claim 12, wherein the slip ring is c-shaped.

18. The coaxial connector of claim 12, wherein the plurality of coupling spring fingers extend from a connector end of the slip ring.

* * * * *